United States Patent [19]

Ringer, Sr.

[11] Patent Number: 4,530,689

[45] Date of Patent: Jul. 23, 1985

[54] COMPUTER PAPER LOADING-AND-UNLOADING DEVICE

[75] Inventor: Billy R. Ringer, Sr., Houston, Tex.

[73] Assignee: Crestmont Corporation, Houston, Tex.

[21] Appl. No.: 448,362

[22] Filed: Dec. 9, 1982

[51] Int. Cl.[3] ..... B65H 45/00

[52] U.S. Cl. ..... 493/410; 270/40; 271/3; 400/613.2

[58] Field of Search ..... 493/409, 410, 411, 412, 493/458; 271/3; 400/613, 613.1, 613.2; 270/39, 40

[56] References Cited

U.S. PATENT DOCUMENTS

| | | | |
|---|---|---|---|
| 1,856,972 | 5/1932 | Sherman et al. | 493/411 |
| 2,077,428 | 4/1937 | Mabon | 400/613.2 |
| 3,712,445 | 1/1973 | Lidstrom | 400/613 |
| 3,712,607 | 1/1973 | Ziegler et al. | 493/411 |

*Primary Examiner*—Lowell A. Larson

*Attorney, Agent, or Firm*—Michael P. Breston

[57] ABSTRACT

A computer paper loading-and-unloading device which is adapted to be positioned next to and spaced from a paper processing unit having a paper receiving station and a paper discharge station. The device has a top level support for supporting a stack of folded computer paper sheets, and a bottom level support under the top support and positioned below the level of the discharge station of the paper processing unit. An upright guide extends across the planes of the top and bottom supports and is adapted to guide the forward motion of the paper sheets underneath the bottom support and into the processing unit. The processed sheets are discharged from the discharge station, fold over, and stack up on top of the bottom support.

8 Claims, 11 Drawing Figures

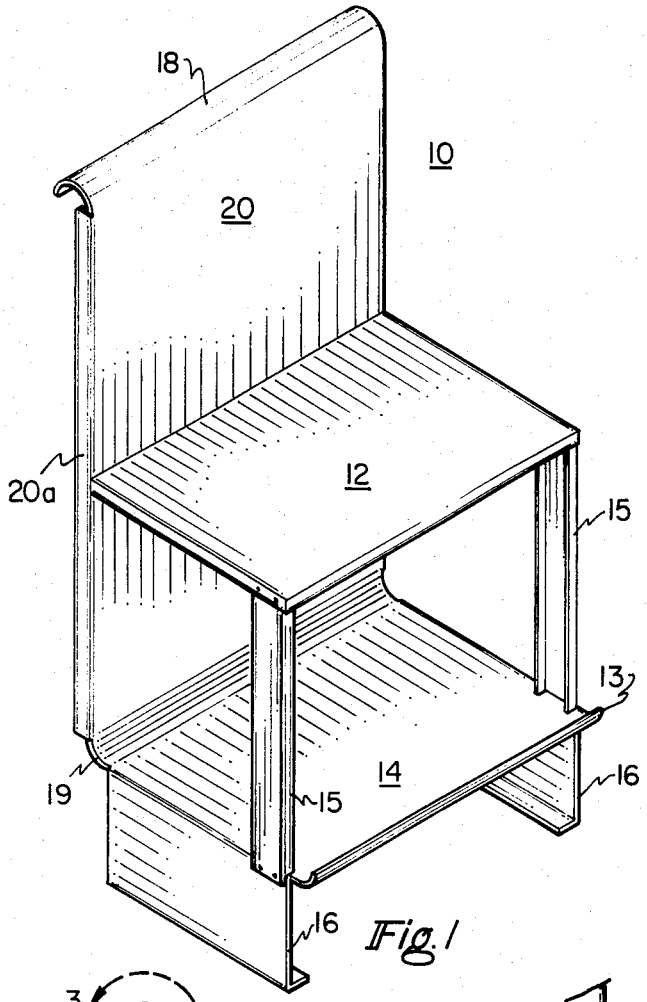
Fig. 1
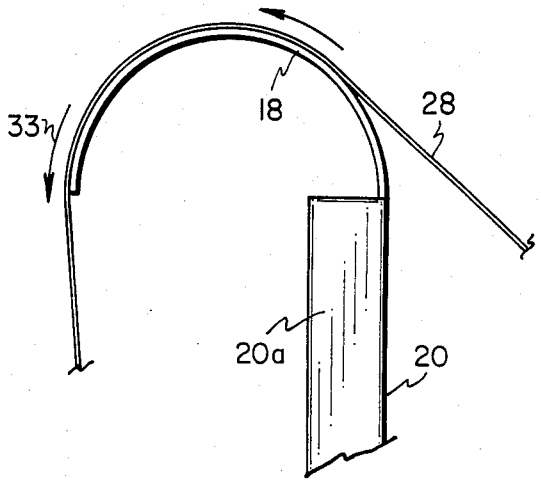
Fig. 3
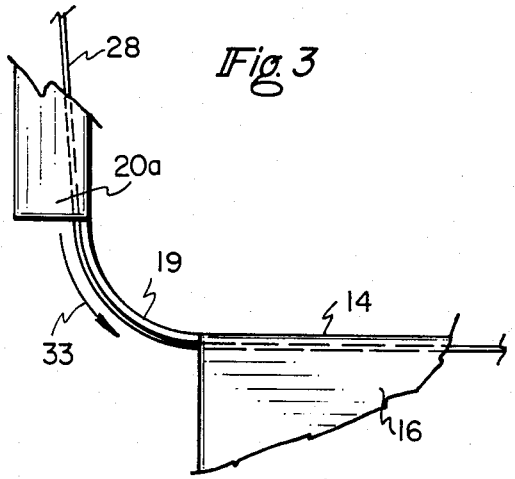
Fig. 4
Fig. 5
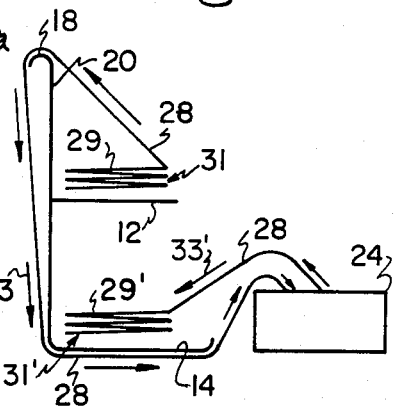
Fig. 6
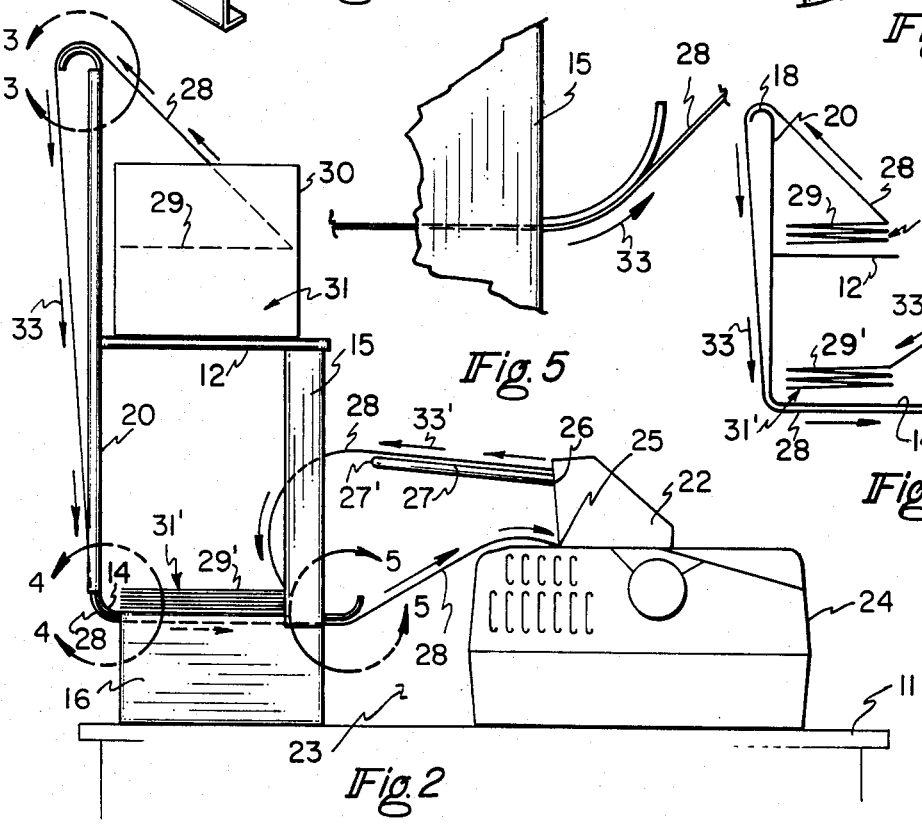
Fig. 2

COMPUTER PAPER LOADING-AND-UNLOADING DEVICE

BACKGROUND OF THE INVENTION

1. Field of the Invention

This invention relates to a device for feeding folded sheets of paper into a paper processing unit, such as the printer of a computer.

2. Description of the Prior Art

The use of computers is gaining greater and greater popularity, especially the smaller-type computers. A computer typically has a computer paper receiving station for continuously receiving the individual folded sheets from a supply stack in a first box, which is positioned under the computer, and a discharge station for discharging the processed sheets into a second box, which is in a position further removed from the first box relative to the computer. Typically, both boxes are maintained on the floor, while the computer sits on the top of a desk.

It will be appreciated that such a procedure in accordance with the prior art imposes an uneconomical use of the expensive floor space around the computer, as well as presents a hazard which may cause the user of the computer to stumble over one of the paper boxes.

It is, therefore, a primary object of the present invention to provide a computer paper loading device which allows the floor space around the computer to be used more economically.

SUMMARY OF THE INVENTION

The computer paper loading-and-unloading device is adapted to be positioned next to and spaced from a paper processing unit having a paper receiving station and a paper discharge station. The device comprises a top level support for supporting a stack of folded computer paper sheets, and a bottom level support under the top support and positioned below the level of the discharge station of the paper processing unit. An upright guide extends across the planes of the top and bottom supports and is adapted to guide the forward motion of the paper sheets underneath the bottom support. The upright guide has a top edge which extends above the supply stack of paper, whereby, in use, the sheets unfolding from supply stack, move over and bend around the top edge from which they fall by gravity. Then the sheets are pulled by the receiving station in the paper processing unit across a space gap which separates the unit from the device. The received sheets are processed by the unit and discharged from the discharge station into the space gap in which the sheets are allowed to fall by gravity, fold over, and stack up on top of the bottom support.

The paper feeding device can be conveniently combined with a paper carriage to form a unitary combination whereby the carriage makes it easy to transport the device and acts at the same time as a stand for the device. The carriage is conveniently provided with one or more shelves for supporting boxes of computer paper.

BRIEF DESCRIPTION OF THE DRAWINGS

FIG. 1 is a view in perspective of a stationary embodiment of the paper loading-and-unloading device in accordance with the present invention;

FIG. 2 is a side view of the device of FIG. 1 shown positioned next to and spaced from a paper processing unit and also illustrates the path of travel of the paper sheets as they unfold from a supply box and are guided into the receiving station of the unit;

FIG. 3 is an enlarged side detail view of the top edge of the vertical guide of the device taken along the circular line 3—3 of FIG. 2;

FIG. 4 is an enlarged side detail view of the rounded bottom edge of the guide taken along circular line 4—4 of FIG. 2;

FIG. 5 is an enlarged side detail view of the deflecting edge extending from the bottom support, on which the processed sheets are stacked up, taken along circular line 5—5 of FIG. 2;

FIG. 6 is a diagram illustrating the path of travel of the computer paper between the device and the paper processing unit;

DETAILED DESCRIPTION OF PREFERRED EMBODIMENTS

Figure 7:
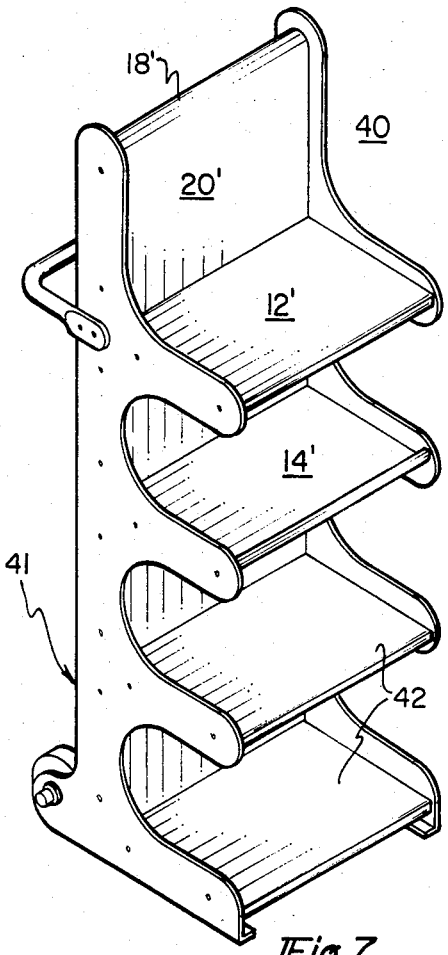
FIG. 7 is a view in perspective of a mobile embodiment of the loading-and-unloading device in accordance with the present invention.
Figure 8:
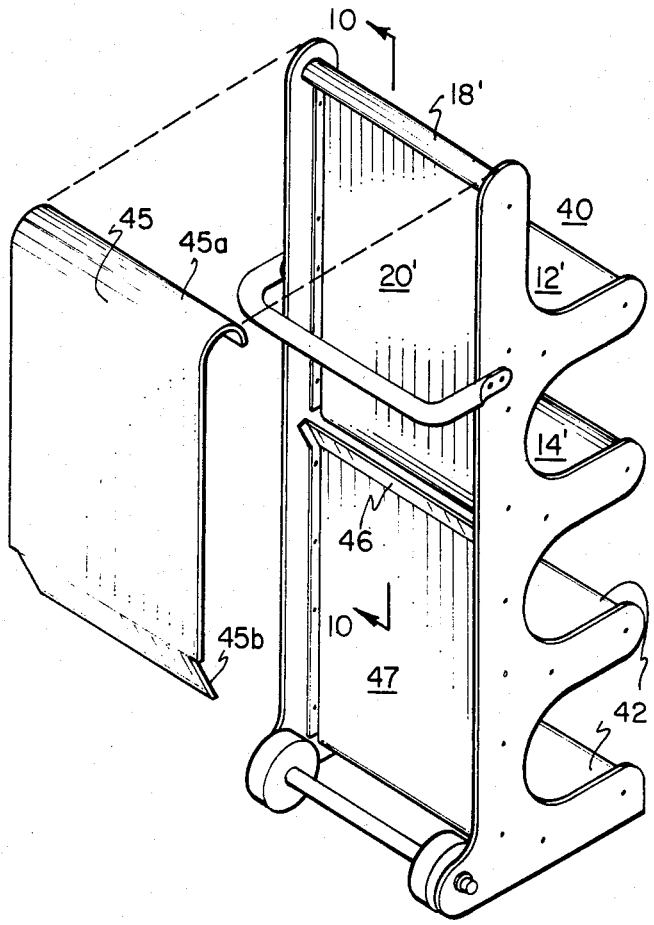
FIG. 8 is an exploded view of a modified embodiment of the mobile device shown in FIG. 7.

To facilitate the understanding of the drawings, similar parts throughout the figures are designated by the same reference characters followed by a prime (').

With reference to FIGS. 1–6, there is shown a stationary paper loading-and-unloading device, generally designated as 10. Device 10 has a top level paper support 12, a bottom level paper support 14 having an outer curved edge 13, a pair of vertical spacers 15 for maintaining supports 12 and 14 in vertical spaced relation, a pair of bottom legs 16, and an upright paper guide 20 which can also structurally serve as a back for level supports 12 and 14.

Upright guide 20 has a top, semi-circular level edge 18 pointing downwardly as viewed in FIG. 1, a bottom curved edge 19, which provides a smooth curvilinear transition between the vertical plane of guide 20 and the horizontal plane of the bottom support 14, and two side edges **20*a*** for confining the paper travel therebetween.

In use, device 10 is positioned on top of a flat surface such as the top of a desk 11. Also positioned opposite to and facing the edge 13 of the bottom support 14 is the printer section 22 of a conventional computer, generally designated as 24. Device 10 and computer 24 are separated from each other by a space gap 23. The printer 22 has a paper receiving station 25 and a paper discharge station 26. Either the receiving or the discharge station or both have paper pulling means, such as sprockets (not shown) for the purpose of pulling therethrough a continuous sheet of punched computer paper 28. The discharge station 26 typically has a flat projection 27 extending into the space gap 23 for the purpose of facilitating the unloading of the discharged processed paper sheets 29'. The outer edge 27' of projection 27 is disposed at a predetermined vertical distance above the bottom support 14. The height of legs 16 may range from a few centimeters to about 10 cms and the legs may be made adjustable as will be readily apparent. The shorter the height of legs 16, the higher the stack 31' of folded processed sheets 29' of paper 28 can be, as will be more fully explained in connection with the use of device 10.

Positioned on top of support 12 is a box 30 containing a stack 31 of folded punched computer paper sheets 29. To start the process of paper feeding into the computer 24, several sheets 29 are normally unfolded from stack 31 and are guided over the top edge 18 of the guide 20. From the edge 18 the sheets move downwardly aided by gravity and negotiate the curved bottom edge 19 to move under the bottom support 14. After being slightly deflected by the curved edge 13 of the bottom support 14, the sheets 29 consecutively enter into the receiving station 25 wherein they are clamped to the pulling device (not shown) within the printer 22. This completes the manual loading of the paper 28 into the computer 24.

Thereafter, the paper 28 will be pulled into the printer 22 mechanically and will be discharged from the discharge station 26 over the projection 27. The length and inclination of projection 27 relative to the horizontal are adjusted so that the processed sheets 29' leaving edge 27' of projection 27 fall by gravity into the space gap 23 and in so doing fold over to form the stack 31' on top of the bottom support 14.

In addition to adjusting the length of projection 27, the width of the space gap 23 can also be adjusted by moving the device 10 toward or away from computer 24. The path of travel of the unprocessed sheets 29 of paper 28 around the feeding device 10 and into the receiving station 25 is indicated by the arrows 33. The path of travel of the processed sheets 29' exiting from the discharge station 26 is indicated by the arrows 33'.

Paper loading-and-unloading device 10, shown in FIGS. 1–6, can be usefully combined with a carriage, such as a two-wheel or four-wheel dolly 41 to form a mobile paperloader device 40. The carriage 41 can be provided with one or more shelves 42 for supporting boxes 43 of computer paper 28. The parts of the mobile device 40, shown in FIGS. 7–11, which correspond to the parts of the device 10, shown in FIGS. 1–6, are designated with the same reference characters followed by a prime (′), and no further description thereof is believed necessary for an understanding of the utility of the mobile device 40.

For some applications, the computer paper 28 may be provided with duplicate carbon copies or other such extra sheets (not shown), and in that regard it may be desirable to confine the traveling paper 28, as it moves over the vertical paper guide 20', within a confined space 44 between the guide 20' and a chute 45 which has a curved lip **45*a* and a straight lip 45*b* which laps over the edge 46 formed on the back 47 of the carriage 41**.

Figure 9:
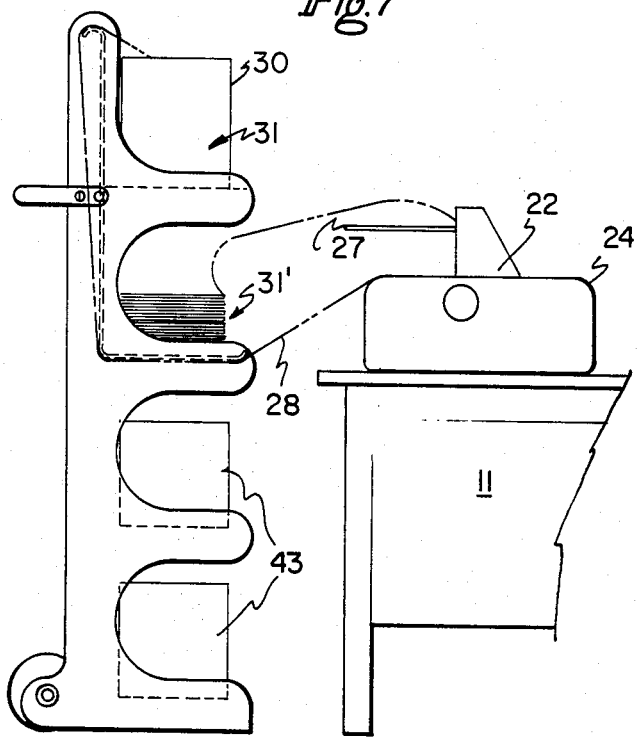
FIG. 9 is a side view of the mobile device of FIG. 7 shown in position for loading and unloading paper into and from a paper processing unit.
Figure 10:
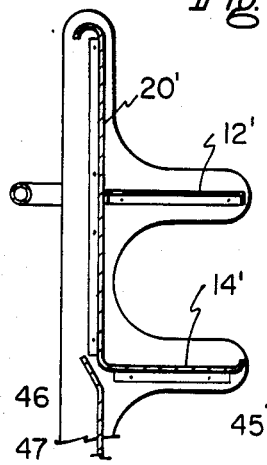
FIG. 10 is a partial sectional view taken along line 10—10 of FIG. 8.
Figure 11:
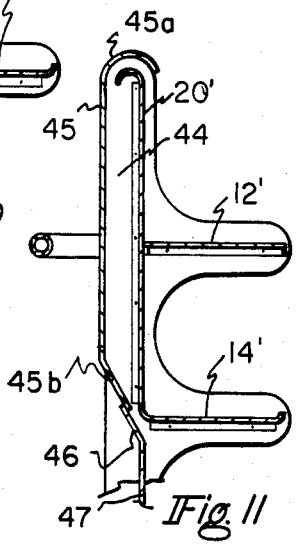
FIG. 11 is a view similar to FIG. 10 but with a chute for confining the traveling paper within a limited space.

The height of the bottom paper support 14' relative to the ground is such as to be approximately at the level of the desk 11 on which the computer sits as shown in FIG. 9.

What is claimed is:

1. A stand for guiding continuous folded flat sheets to and from a sheet processing unit which has upper and lower sheet guides, the stand being adapted to become positioned rearwardly of and in a predetermined vertical position relative to said sheet guides;

the stand having a frame formed of a back plate, an upper shelf, and a lower shelf, which is vertically spaced apart from and vertically aligned with the upper shelf, the plate and the shelves together constitute supports and guides for the folded sheets as they are fed to the processing unit and as they become discharged therefrom after the processing operation;

said back plate extending downwardly across the planes of said upper and lower shelves, which are disposed forwardly of said plate and rearwardly of said processing unit;

the upper shelf, in use, supports a supply stack of folded paper sheets that are intended to be torn off in sections from the stack;

the lower shelf is in a plane below the rear end of the unit's lower sheet guide, and the top face of the lower shelf receives the returned sheets from said unit;

said back plate having an upper horizontal edge extending at a vertical distance above the plane of said upper shelf;

whereby, in use, the sheets unfold from the supply stack on the upper shelf, the unfolded sheets move upwardly, pass over the upper horizontal edge, thence move downwardly over the rear face of the back plate which guides and directs the forward motion of the sheets in a continuous manner underneath the bottom face of the lower shelf, the sheets exit from the stand and flow into the processing unit over its lower sheet guide, and the discharged sheets leave the processing unit over its upper sheet guide and discharge therefrom at a point above the bottom shelf and drop over the top face of the lower shelf where they refold into a flat stack of folded sheets.

2. The stand according to claim 1, wherein the back plate has rearwardly extending flanges on each vertical side thereof which define therebetween a channel that serves to properly track the forward flow of the sheets toward the bottom face of the lower shelf.

3. The stand according to claim 2, wherein the lower shelf has downwardly extending flanges on each lateral side thereof which define therebetween a channel that serves to properly track the forward flow of the sheets toward the processing unit.

4. A stand for guiding continuous folded flat sheets to and from a sheet processing unit of a printer which has upper and lower sheet guides, the stand being adapted to become positioned rearwardly of and in a predetermined vertical position relative to the sheet guides;

the stand having an inverted unitary F-shape frame formed of a back plate, an upper shelf, and a lower shelf, which is vertically spaced apart from and vertically aligned with the upper shelf, the plate and the shelves together constitutes supports and guides for the folded sheets as they are fed to the printer and as the work sheets become discharged therefrom after the printing operation;

said back plate extending substantially perpendicularly across the planes of said upper and lower shelves, which are disposed forwardly of said plate and rearwardly of said printer;

the upper shelf is in a plane above the rear end of the printer's upper sheet guide and, in use, supports a supply stack of folded paper sheets that are intended to be torn off in sections from the stack;

the lower shelf is in a plane below the rear end of the printer's lower sheet guide, and the top face of the lower shelf receives the returned sheets from the printer;

said back plate is in back of both shelves and the plate has an upper curved horizontal edge, at a vertical distance above the plane of said upper shelf, and a lower horizontal edge near the plane of said lower shelf;

whereby, in use, the sheets unfold from the stack on the upper shelf, the unfolded sheets move upwardly, pass over the upper horizontal edge, thence move downwardly over the rear face of the back plate which guides and directs the forward motion of the sheets in a continuous manner underneath the bottom face of the lower shelf, and the sheets exit from the stand and flow forwardly and upwardly and into the processing unit of the printer over its lower sheet guide, the movement being smooth between the lower horizontal edge of the back plate and the bottom face of the lower shelf to prevent buckling of the sheets below the plane of the lower shelf; the sheets leaving the printer over its upper sheet guide, discharge therefrom at a point above the bottom shelf, flow rearwardly and downwardly, drop by gravity over the top face of the lower shelf where they refold into a flat sheet stack, and the sheets advancing from the lower shelf toward the printer are below and do not interfere with the sheets receding from the printer toward the lower shelf.

5. The stand according to claim 4, wherein the back plate has rearwadly extending flanges on each side thereof which define therebetween a channel which serves to properly track the forward flow of the sheets toward the bottom face of the lower shelf.

6. The stand according to claim 5, wherein the lower shelf has downwardly extending flanges on each lateral side thereof which define therebetween a channel that serves to properly track the forward flow of the sheets toward the processing unit of the printer.

7. A method for continuously guiding folded flat sheets from a supply stack to and from a sheet processing unit which has a lower sheet receiving guide and an upper sheet discharge guide, comprising the steps of:

maintaining said supply stack at an upper elevation relative to said discharge guide;

feeding from the supply stack the unfolded sheets in an upward direction, thence downwardly, thence in a horizontal forward direction toward said unit, and thence forwardly and upwardly into said unit over its sheet receiving guide; and feeding the discharged sheets from the unit's discharge guide rearwardly and downwardly to allow the sheets to fall by gravity and stack up at a lower elevation which is below the unit's receiving guide.

8. A method for guiding continuously folded flat sheets to and from a stand positioned next to and separated by a space gap from a sheet processing unit having a lower sheet receiving guide and an upper sheet discharge guide, comprising the steps of:

supporting a stack of flat folded sheets on a supply shelf above the sheet discharge guide;

continuously feeding from the stack unfolded sheets in an upward direction, thence downwardly, thence in a horizontal forward direction toward said unit, thence forwardly and upwardly, over said sheet receiving guide, and into the processing unit; and feeding the discharged sheets from said discharge guide rearwardly and downwardly to allow the sheets to fall by gravity and stack up on the top face of a bottom shelf spaced below the sheet receiving guide, and said horizontal forward direction being underneath said bottom shelf.

* * * * *